US009901148B2

(12) United States Patent
Steve

(10) Patent No.: US 9,901,148 B2
(45) Date of Patent: Feb. 27, 2018

(54) SURVIVAL WATCH

(71) Applicant: Eilers Steve, Grand Rapids, MI (US)

(72) Inventor: Eilers Steve, Grand Rapids, MI (US)

( * ) Notice: Subject to any disclaimer, the term of this patent is extended or adjusted under 35 U.S.C. 154(b) by 0 days.

(21) Appl. No.: 15/009,878

(22) Filed: Jan. 29, 2016

(65) Prior Publication Data

US 2017/0215529 A1 Aug. 3, 2017

(51) Int. Cl.

| | |
|---|---|
| ***A44C 5/00*** | (2006.01) |
| ***A44C 5/18*** | (2006.01) |
| ***G04B 37/14*** | (2006.01) |

(52) U.S. Cl.

CPC ..... *A44C 5/0053* (2013.01); *A44C 5/0007* (2013.01); *A44C 5/18* (2013.01); *G04B 37/14* (2013.01)

(58) Field of Classification Search

CPC ..... A44C 5/0007; A44C 5/04; G04B 37/14
See application file for complete search history.

(56) References Cited

U.S. PATENT DOCUMENTS

| | | | | |
|---|---|---|---|---|
| 3,371,351 | A | 3/1968 | Allain | |
| 4,177,522 | A | 12/1979 | Auburn | |
| 4,183,206 | A | 1/1980 | Porsche | |
| 5,106,004 | A * | 4/1992 | Nguyen | A41F 9/002 224/152 |
| 5,854,773 | A | 12/1998 | Lee | |
| 6,870,796 | B2 * | 3/2005 | Elling | G04B 37/1433 2/171 |
| 7,125,145 | B2 | 10/2006 | Gardiner | |
| 7,447,118 | B1 | 11/2008 | Matos | |
| 8,756,955 | B2 | 6/2014 | Walchle | |
| 8,925,348 | B2 | 1/2015 | Gagne | |
| 9,021,664 | B2 | 5/2015 | Ingalls | |
| 9,084,455 | B2 | 7/2015 | Millan | |
| 2003/0177561 | A1 * | 9/2003 | Sloot | A01K 11/00 2/16 |
| 2003/0193844 | A1 * | 10/2003 | Elling | G04B 37/1433 368/282 |
| 2009/0173760 | A1 | 7/2009 | Good | |
| 2010/0050690 | A1 | 3/2010 | Woodward | |
| 2013/0020359 | A1 * | 1/2013 | Green | A45F 5/00 224/222 |
| 2013/0031935 | A1 | 2/2013 | Kelleghan | |
| 2013/0189631 | A1 | 7/2013 | Mojica | |
| 2013/0224667 | A1 | 9/2013 | Roybal | |
| 2014/0109615 | A1 * | 4/2014 | Millan | B26B 9/00 63/1.12 |
| 2015/0128643 | A1 | 5/2015 | King | |
| 2015/0135768 | A1 | 5/2015 | Barrick | |
| 2015/0282571 | A1 * | 10/2015 | Gendron | A44C 5/0007 206/372 |

* cited by examiner

*Primary Examiner* — Amy Cohen Johnson
*Assistant Examiner* — Jason Collins
(74) *Attorney, Agent, or Firm* — Varnum, Riddering, Schmidt & Howlett LLP

(57) ABSTRACT

A survival wristwatch includes a timepiece and a wristband that include integrated survival kit features for assisting a user with various survival tasks. The wristband includes a cord, or paracord, winding or braiding around a strap. The strap is uniquely designed to integrate with the cord and provide adjustability of the wristband.

12 Claims, 5 Drawing Sheets

SURVIVAL WATCH

FIELD OF INVENTION

The present invention relates to a wristwatch having integrated survival kit features for assisting a user with various survival tasks.

BACKGROUND

Watches, including wristwatches, are traditionally available in a variety of shapes and sizes. It is known for watches to include a dial or face for displaying the time and a wristband for attaching the watch to the wrist of a user. The wristband commonly includes a first piece connected to a first side of the face and a second piece connected to a second side of the face. The wristband pieces may be connected together by a fastener to fix the watch on a user's wrist.

In some cases, watches may be modified to include additional features and devices to assist with specific tasks. For example some watches are configured to specifically include tools and other implements designed to assist with outdoor and wilderness survival. These tools may assist with specific survival tasks, such as providing directional assistance, cutting objects, starting fires, and the like.

One drawback that many survival watches face is providing a functional but practical arrangement for the survival tools on the watch. While the face of the watch is often the most accessible location for any such tools, there is a lack of space on the face for attaching them without blocking the view of the timepiece. Accordingly, many designs utilize other areas of the watch, for placing tools. However, there may be drawbacks to this type of arrangement as well.

One option is to attach tools and devices along the wrist band. However, the band may be designed to serve specific survival purposes. For example, some wristbands are composed of a cord material to assist with various survival functions. The cord may be wrapped or braided in a specific manner to form the portions of the wristband. Attaching tools or implements to the wristband may be difficult, and may become detached if the cord is unbraided to be used.

Another option is to position tools and implements on the fastener or watch buckle. However there is limited space on the buckle for arranging such components.

An additional design consideration for watches that utilize a cord-type wristband is that they often lack means for adjustability. In traditional watches, such as leather-banded watches, the wristband may include a series of openings arranged circumferentially around the wristband. The openings may allow the wristband to be selectively buckled at a desired length. Other watches have wristbands that are comprised of a plurality of links. The length of the wristband can be adjusted by removing or adding in links into the wristband.

Watches with cord-type wristbands are not able to employ traditional buckles with holes pierced in the wristband because the cord does not provide a flat surface for piercing holes. Further, cord-type wristbands are not adjustable in the same manner that linked wristbands are adjustable.

Accordingly, the need exists for an improved design for a watch having survival features.

SUMMARY

A survival wristwatch is generally presented. The survival wristwatch includes a timepiece having a face for providing time and a wristband connected to the timepiece. The wristband is comprised of a first wristband portion and a second wristband portion. The first wristband portion includes a first end connected to a first side of the timepiece and a second end connected to a first connection piece. The second wristband portion comprises a strap having a first strap end connected to a second side of the timepiece. The strap includes a first length of strap extending from the first strap end and a second length of strap extending from the first strap end. A cord may be wound around at least a portion of the strap to form a passageway in the interior of the cord winding.

The first length of strap extends along the entire passageway in the cord and exits through an end opening of the cord passageway, terminating outside of the passageway. The second length of strap extends from the first strap end into the passageway and exits the passageway through an opening between the cord. The second length of strap is selectively connectable to the first length of strap.

A second connection piece may be connected to the strap and adjustable along the length of the strap. The second connection piece may further be connectable to the first connection piece.

In an embodiment, the watch strap may be formed of nylon, and the first length of strap may be selectively connectable to the second length of strap by way of a Velcro connection. The first wristband portion may include a second strap connected to the first side of the timepiece and connected to the first connection piece, and may further comprise a cord wound around the second strap.

In an embodiment, the second length of strap may be looped back into the passageway through the end opening of the cord passageway. The second length of strap may include a portion of connectable material, such as Velcro, exposed on an outer part of the wristband.

BRIEF DESCRIPTION OF THE DRAWINGS

The operation of the invention may be better understood by reference to the detailed description taken in connection with the following illustrations, wherein.

DETAILED DESCRIPTION

Figure 1:
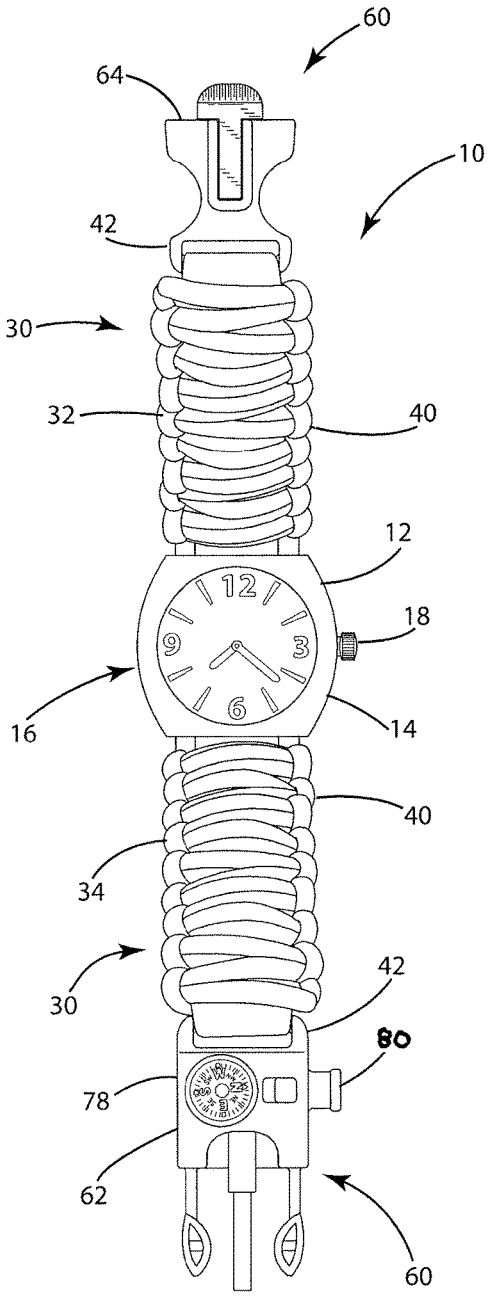
FIG. 1 illustrates a top view of a survival watch.
Figure 2:
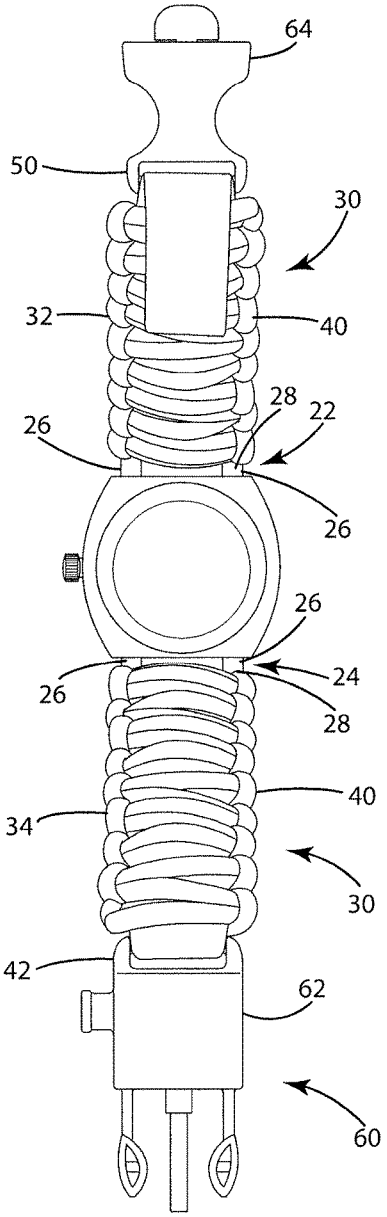
FIG. 2 illustrates a bottom view of a survival watch with the adjustable band connected to wristband.
Figure 3:
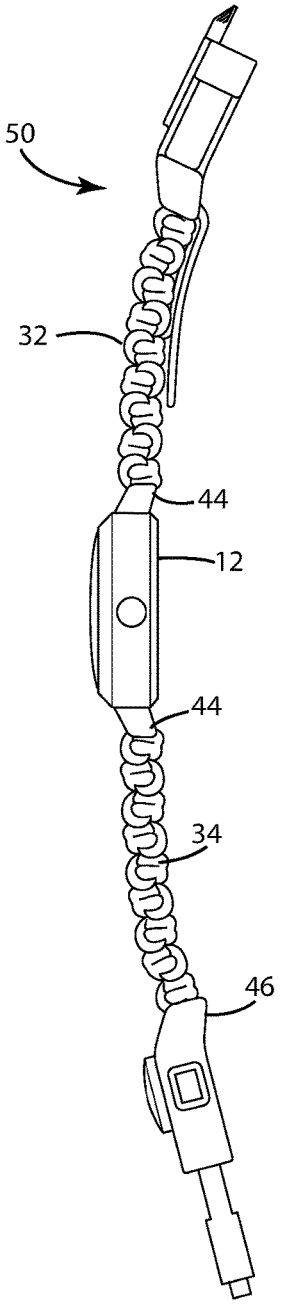
FIG. 3 illustrates a side view of a survival watch with the adjustable band connected to the wristband.
Figure 4:
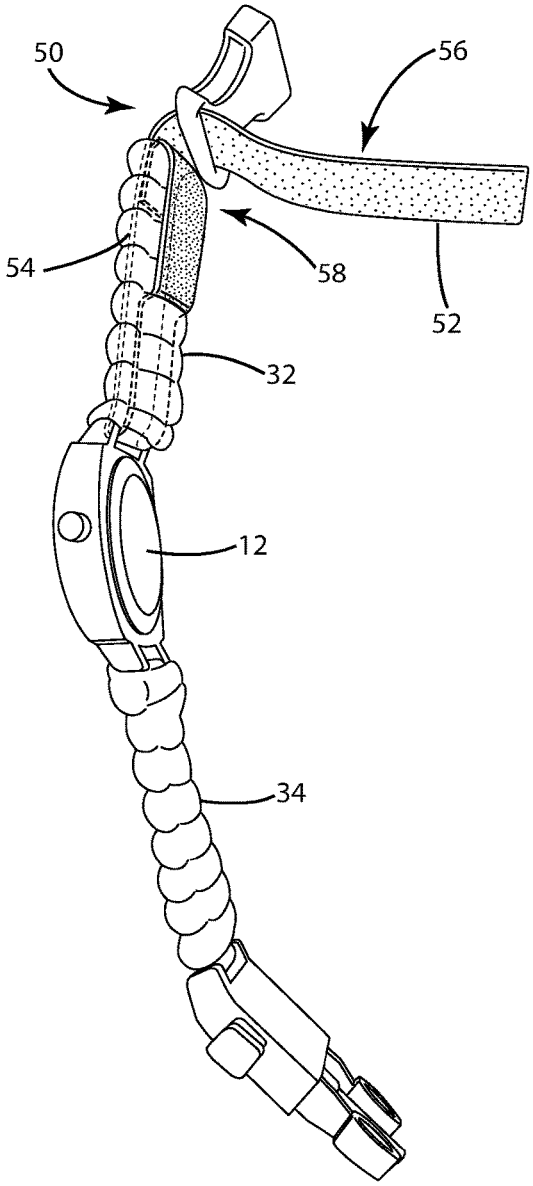
FIG. 4 illustrates a side view of a survival watch with the adjustable band disconnected from the wristband.
Figure 5:
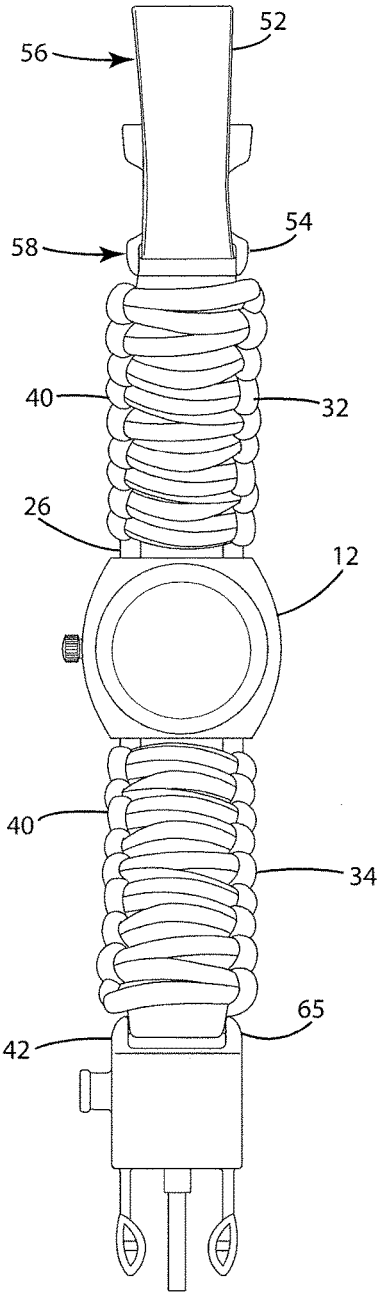
FIG. 5 illustrates a bottom view of a survival watch with the adjustable band disconnected from the braided cord.
Figure 6:
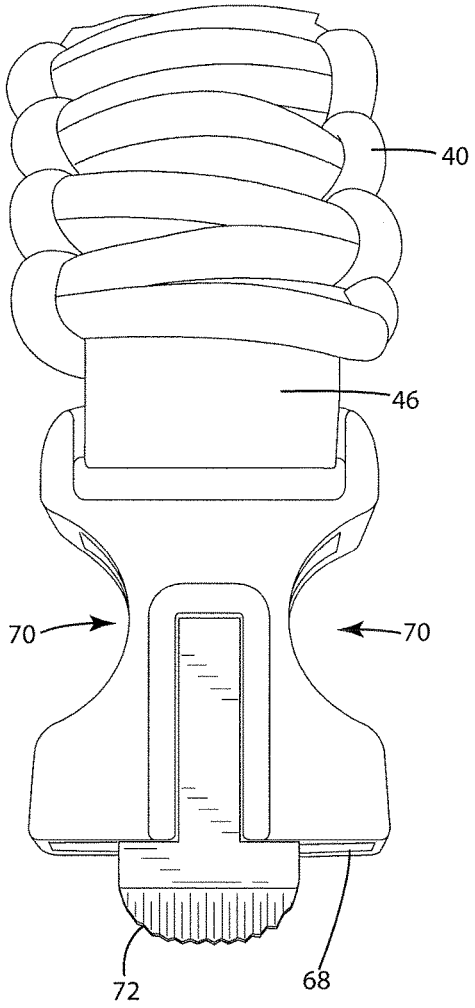
FIG. 6 illustrates a top detailed view of a first buckle portion connected to a wristband portion.
Figure 7:
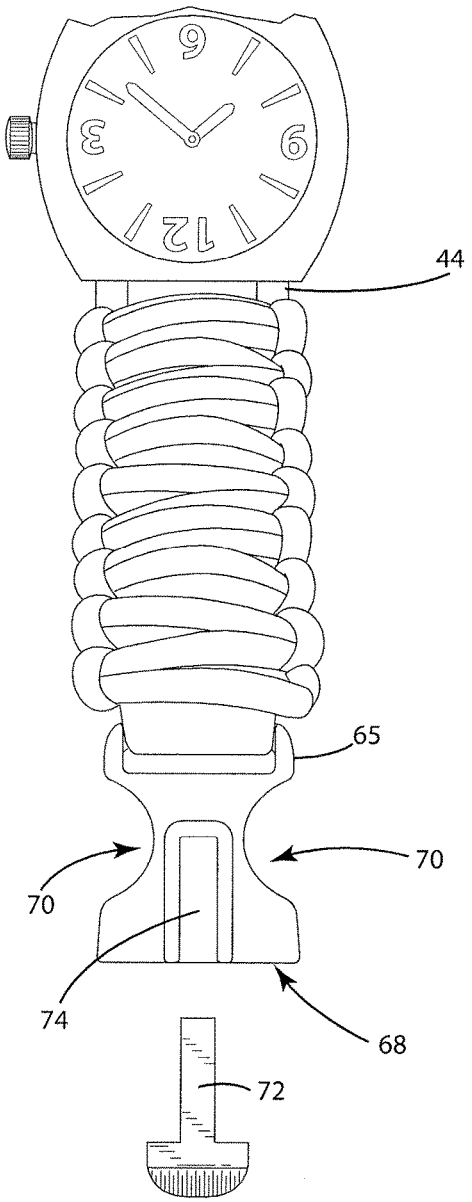
FIG. 7 illustrates a top view of a first buckle portion connected to a wristband with a striker removed from the buckle portion.
Figure 8:
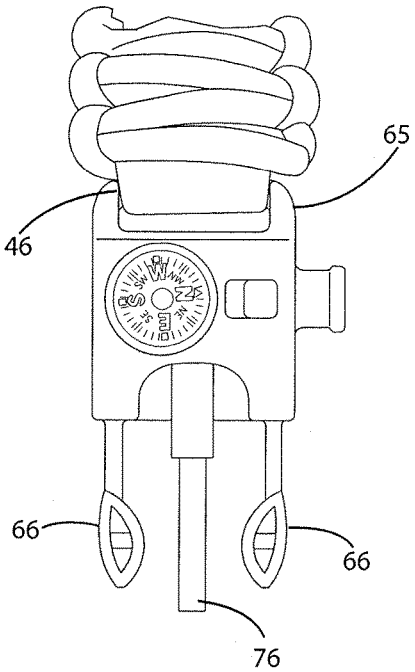
FIG. 8 illustrates a top view of a second buckle portion connected to a wristband portion.
Figure 9:
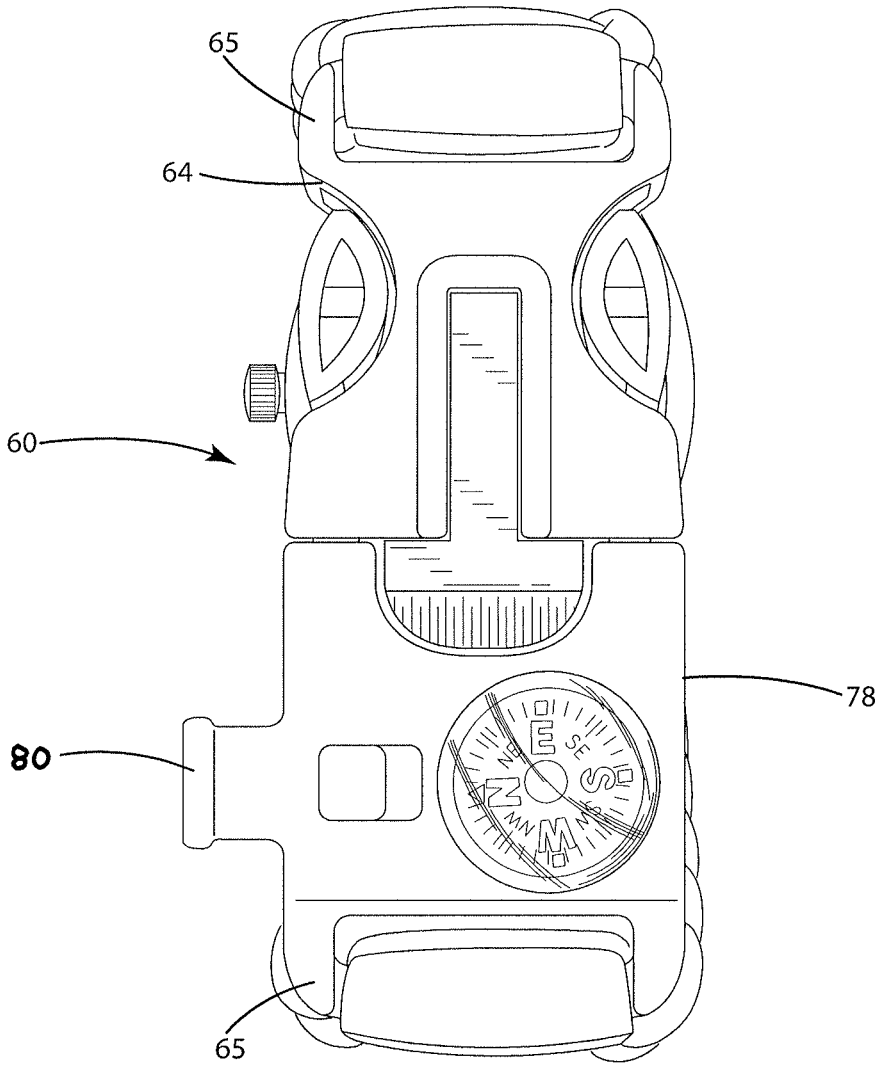
FIG. 9 illustrates a first buckle portion connected to a second buckle portion and the buckle connected to the wristband.

Reference will now be made in detail to exemplary embodiments of the present invention, examples of which are illustrated in the accompanying drawings. It is to be understood that other embodiments may be utilized and structural and functional changes may be made without departing from the respective scope of the invention. Moreover, features of the various embodiments may be combined or altered without departing from the scope of the invention. As such, the following description is presented by way of illustration only and should not limit in any way the various alternatives and modifications that may be made to the illustrated embodiments and still be within the spirit and scope of the invention.

A survival watch 10 is generally presented. The survival watch 10 may be configured to attach to a user's body, such as to a user's wrist, and provide timekeeping while also providing other various outdoor or wilderness survival tools. These tools may include a versatile cord, compass, whistle, and other similar features.

The survival watch 10 may include a timepiece 12. The timepiece 12 may comprise a case 14 having any appropriate size and shape, such as generally flat and having a squared or circular shape. The case 14 may house various components, including a watch face 16 for keeping time and internal components related to the function of the watch. The face 16 may be an analog watch face (as shown in the FIGS) or a digital face. The analog face 16 may include one or more crowns 18 to set the timepiece 12 and operate features of the watch 10. The face 16 may selectively include other features, such as a stopwatch, timer, alarm, light, date keeping, or other similar features commonly included on wristwatches.

The survival watch 10 may be configured to attach to a wristband portion at each end of the timepiece 12. For example, the timepiece 12 may include a first pin assembly 22 at a first end of the timepiece 12 and a second pin assembly 24 at a second end of the timepiece 12 opposite the first end. The pin assemblies 22, 24 may each include a pair of arms 26 connected to and extending away from the case 14. The arms 26 may be spaced a distance apart on each side of the timepiece 12.

A pin 28 may be fixed between each set of arms 26. The pin 28 may be spring loaded to facilitate insertion and removal of the pin 28 from between the arms 28. The pin may provide a connection point for a wristband, as described in further detail below.

The survival watch 10 may include a wristband 30 to provide attachment to a user's body, such as the user's wrist or arm. The wristband 30 may include a first portion 32 and a second portion 34, each connected to a pin assembly 22, 24 and connectable to each other. For example, the first portion 32 may connect to the first pin assembly 22 my looping around the pin 28. Likewise, the second portion 34 may connect to the second pin assembly 24 by looping around the pin 28.

In an embodiment, the wristband 30 may include a cord 40. The cord 40 may be any appropriate cord, such as parachute cord commonly referred to as paracord. The cord 40 may form part of each portion 32, 34 of the wristband 30.

The cord may be configured in a wound or braided arrangement along the length of the wristband 30. For example, as illustrated in the FIGS, the cord 40 may be configured in a zigzag arrangement along the surface of the wristband 30 with cord loops along the side of the wristband 30 to hold the zigzagged cord 40 in place. The zigzag portions may have spaces between them, as illustrated in the FIGS. It will be appreciated, however, that any appropriate braided or wound arrangement may be used along the surface of the wristband 30.

In an embodiment, the wristband 30 may include a strap 42 integrated with the braided cord 40. The strap 42 may be formed of any appropriate and pliable material, such as nylon. The strap 42 may be used to connect the wristband 30 to the timepiece 12 and to any appropriate connector or buckle, as well as to provide additional functionality. For example, the strap 42 may provide an improved mechanism for forming the braid, and may allow for adjustability of the wristband 30, as described in further detail below.

The strap 42 may include a first eyelet 44 at its first end. The first eyelet 44 may be configured to receive the pin 28 therein and connect the strap 42 to the timepiece 12. A second eyelet 46 may be positioned at the second end of the strap 42 and configured to connect to a buckle or other wristband connector.

The wristband 30 may be arranged with the strap 42 at least partially under or inside the braded cord 40. Specifically, the cord 40 may be wound or braided around the strap 42 to form a passageway therethrough, with the strap 42 residing at least partially within the passageway. This arrangement may provide a benefit over other braided cord wristbands that must be braided and wound upon themselves. In addition, the strap 42 provides an easier connection to the timepiece 12 and buckle as opposed to tying or braiding the cord 40 directly to the timepiece 12 and buckle.

In an embodiment, the strap 42 may include an adjustable end 50 in place of the second eyelet 46. The adjustable end 50 may allow the wristband 30 to be selectively adjusted to a desired length. For example, the strap 42 may include Velcro patches along at least a portion of its length. The Velcro patches may include rough hook patches 52 and soft loop patches 54 that connect to each other. The strap 42 may connect to the timepiece 12 at the first eyelet 44 and extend from the eyelet 44 in two separate sections, a first strap section 56 and a second strap section 58, through the center of the braided cord 40.

The first section 56 may extend from the eyelet 44 through the passageway of the braided cord 40, exiting the passageway through an opening at the end of the cord 40. In other words, the first strap section 56 may extend through the entire passage way of the cord 40. The first strap section 56 may include a rough hook patch 52 of Velcro located on at least a portion its underside.

The second section 58 may extend from the eyelet 44 through a portion of the wound cord passageway or interior and exit from the interior through a space between the cords 40, such as a space between the zigzag winding or braiding. The second section 58 may then loop back into the passageway opening in the end of the wound cord 40 opposite the timepiece 12. The second section 58 may include a soft loop patch 54 of Velcro located on at least a portion of its underside and exposed on the exterior of the wristband 30. The rough hook patch 52 of the first strap section 56 may connect to the soft loop patch 54 of the second strap section 58 to the selectively adjust the length of the first strap section 56.

In the described configuration, the adjustable end 50 may reside entirely within the braided cord 40 other than the portion of the second section 58 that exits the interior of the cord 40. This portion of the second section 58 includes a soft loop patch 54 on its outer surface to allow the first section 56 to connect thereto at the desired length.

While the wristband 30 is shown and described using a Velcro connection means, it will be appreciated that any connection means, such as adhesive or any other type of connection to allow the adjustable end 50 to connect to itself, may be used.

It will be appreciated that the survival watch 10 may include an adjustable end 50 on both the first and second wristband portions 32, 34 or may be include an adjustable end 50 on only one of the two wristband portions 32, 34.

The survival watch 10 may include a buckle 60. The buckle 60 may include a first buckle portion 62 and a second buckle portion 64 each connected to respective wristband portions 32, 34. The buckle 60 may be made of any appropriate material, such as plastic or metal, and may be any appropriate style of buckle capable of connecting the wristband portions 32, 34. The first and second buckle portions 62, 64 may each include a loop or ring 65 for attachment to the respective wristband portions 32, 34.

In an embodiment, the first buckle portion 62 may be insertable into the second buckle portion 64. For example, the first buckle portion 62 may include one or more prongs 66 extending outward and configured to engage an opening 68 in the second buckle portion 64. The prongs 66 may flex inward to enter the opening then flex back outward into recessed holes 70 in the second buckle portion 64, to lock the buckle 60 into an engaged position.

In an embodiment, the buckle 60 may include fire starting features. For example, the buckle 60 may include a flint starter 72 located on the second buckle portion 64, such as retained in a slotted opening 74 on the top of the second buckle portion 64. The first buckle portion 62 may further include a magnesium rod 76 located between the prongs 66. The flint starter 72 may include a sharpened or serrated edge for scraping shavings from the magnesium rod 76 an igniting a spark.

In an embodiment, the buckle 60 may further include additional survival features, such as a whistle 80 or a compass 78. The whistle 80 and compass 78 may be arranged to be both on the first buckle portion 64.

Although the embodiments of the present invention have been illustrated in the accompanying drawings and described in the foregoing detailed description, it is to be understood that the present invention is not to be limited to just the embodiments disclosed, but that the invention described herein is capable of numerous rearrangements, modifications and substitutions without departing from the scope of the claims hereafter. The claims as follows are intended to include all modifications and alterations insofar as they come within the scope of the claims or the equivalent thereof.

I claim:

1. A wristwatch comprising:

a timepiece having a face for providing time;

a wristband connected to the timepiece, the wristband including a first wristband portion and a second wristband portion, the first wristband portion having a first end connected to a first side of the timepiece and a second end connected to a first connection piece, and the second wristband portion comprising:

a strap having a first strap end connected to a second side of the timepiece;

a first length of strap extending from the first strap end and a second length of strap extending from the first strap end;

a cord wound around at least a portion of the strap and forming a passageway therethrough, wherein the cord is wound around the strap in a braided manner;

wherein the first length of strap extends along the entire passageway and exits through an end opening of the braided cord passageway, terminating outside of the passageway;

wherein the second length of strap extends from the first strap end into the passageway and exits the passageway through an opening between the cord and further extends along the outer surface of the braided cord;

wherein the first length of strap is selectively connectable to the second length of strap to adjust the length of the second wristband portion; and a second connection piece connected to the strap and adjustable along the length of the strap, the second connection piece connectable to the first connection piece.

2. The wristwatch of claim 1, wherein the strap is nylon.

3. The wristwatch of claim 1, wherein the first length of strap is selectively connectable to the second length of strap by way of a Velcro connection.

4. The wristwatch of claim 1, wherein the first wristband portion comprises a second strap connected to the first side of the timepiece and connected to the first connection piece.

5. The wristwatch of claim 4, wherein the first wristband portion further comprises a cord wound around the second strap.

6. The wristwatch of claim 1, wherein the first and second connection pieces comprise a first and second buckle piece connectable to one another.

7. The wristwatch of claim 1, wherein the first strap end of the strap comprises an eyelet.

8. The wristwatch assembly of claim 7, wherein the eyelet engages a pin assembly connected to the timepiece.

9. The wristwatch of claim 1, wherein the second length of strap is looped back into the passageway through the end opening of the cord passageway.

10. The wristwatch of claim 1, wherein the timepiece is analog.

11. The wristwatch of claim 1, wherein the cord is a paracord.

12. The wristwatch of claim 1, wherein the braided cord includes a zigzag configuration.

* * * * *